US010448667B2

(12) United States Patent
Schmidt et al.

(10) Patent No.: US 10,448,667 B2
(45) Date of Patent: Oct. 22, 2019

(54) CLOSURE SYSTEM FOR A HOOKAH

(71) Applicant: Schmidt Innovations GmbH, Lohr am Main (DE)

(72) Inventors: Alexander Schmidt, Lohr am Main (DE); Stefan Schmidt, Lohr am Main (DE)

(73) Assignee: Schmidt Innovations GmbH, Lohr am Main (DE)

( * ) Notice: Subject to any disclaimer, the term of this patent is extended or adjusted under 35 U.S.C. 154(b) by 472 days.

(21) Appl. No.: 15/280,243

(22) Filed: Sep. 29, 2016

(65) Prior Publication Data

US 2018/0084825 A1 Mar. 29, 2018

(51) Int. Cl.
*A24F 1/30* (2006.01)

(52) U.S. Cl.
CPC ..... *A24F 1/30* (2013.01)

(58) Field of Classification Search
CPC ..... A24F 1/30
See application file for complete search history.

(56) References Cited

U.S. PATENT DOCUMENTS 5,726,421 A * 3/1998 Fleischhauer ..... A24F 47/008 131/182
2009/0095310 A1* 4/2009 Chaoui ..... A24F 1/30 131/173
2013/0192615 A1* 8/2013 Tucker ..... H01C 17/00 131/328
2014/0305447 A1* 10/2014 Saco ..... A24F 1/30 131/225
2015/0327597 A1* 11/2015 Li ..... A24F 47/008 131/329

* cited by examiner

*Primary Examiner* — Eric Yaary
(74) *Attorney, Agent, or Firm* — McGlew and Tuttle, P.C.

(57) ABSTRACT

A closing system, of a hookah (01), has a first closing element (13), which can be attached to a water base (02) of the hookah (01), and a second closing element (16), which includes at least one connecting opening for at least one hookah hose (12) and at least one continuous opening (22) for a connection permeable to air between the water base (02) and a hookah stem (07), arranged directly or indirectly at a second closing element (16). The second closing element (16) has an essentially cylindrical portion (18), which can be inserted into a recess in the first closing element (13) and is complementary in shape and function to the cylindrical portion (18). The cylindrical portion (18) includes an indentation (31) in an area of an outer wall, a displaceable locking element (35) provided in an inner wall of the recess being detachably engageable in the indentation (31).

17 Claims, 5 Drawing Sheets

CLOSURE SYSTEM FOR A HOOKAH

FIELD OF THE INVENTION

The invention relates to a closing system for a hookah having a first closing element, which can be attached to a water base of the hookah, and a second closing element, which comprises at least one connecting opening for at least one hookah hose and at least one continuous opening for a connection permeable to air between the water base and a hookah stem arranged directly or indirectly at the second closing element.

BACKGROUND OF THE INVENTION

Hookahs, also called shishas, generally consist of a water base, also called vase, and a closing system which is attached on the water base. At the bowl, which simultaneously serves as a closing system for the water base, a hookah stem is attached, at the upper end of which a hookah tray is arranged on which hot coals and tobacco are burned or vaporized, respectively. The hookah stem extends through the bowl into the water base and opens below the water level into the water base with its lower end. Furthermore, connectivity is provided for at least one hookah hose opening into the air space provided in the water base between the bowl and the liquid level via a corresponding recess. When a user sucks on the hookah hose, a negative pressure is produced in the air space provided in the water base, tobacco smoke being sucked through the hookah stem by means of said negative pressure and being purified, cooled and/or humidified when passing through the liquid.

It is therefore of significant importance that the closing system completely seals the water base, since otherwise secondary air is sucked in and the hookah does not have the necessary draw strength.

Known closing systems, for example, are formed as a type of insertable closing system, wherein the entire bowl is simply inserted into the opening of the water base and is sealed there using rubber seals. A particular disadvantage is that the connection between the closing system and the water base is not sufficiently tight. As a result, it is barely possible, for example, to lift the entire hookah at the bowl without releasing the connection between the bowl and the water base. In many cases, this leads to hot coals falling from the coal tray and causing injuries to the user or damage to furniture when handled improperly.

Other screwable closing system for being arranged between the water base, generally made of glass, and the closing system are known; however, these closing systems are cumbersome to use and time-consuming. Thus, undesired noises are created when screwing and unscrewing the closing system, an effect particularly undesired when using the hookah in public spaces, such as hookah bars. These noises occur more often with increasing service life of the hookah, since lime residue, depending on the water quality, regularly builds up in the thread and the threads at the glass body of the water base are worn away relatively quickly.

SUMMARY OF THE INVENTION

Based on this prior art, it is an object of the present invention to provide a closing system for a hookah which is easy to use and allows a safe and secure connection at the water base.

The object is attained by the closing system of a hookah having a first closing element, which can be attached to a water base of the hookah, and a second closing element, which comprises at least one connecting opening for at least one hookah hose and at least one continuous opening for a connection permeable to air between the water base and a hookah stem arranged directly or indirectly at the second closing element. The second closing element has an essentially cylindrical portion that can be inserted into a recess in the first closing element. The recess is complementary in shape and function to the cylindrical portion. The cylindrical portion comprises at least one indentation in an area of an outer wall thereof. At least one displaceable locking element is provided in the inner wall of the recess being detachably engageable in the indentation.

The closing system for a hookah according to the invention at hand comprises a first closing element, which can be attached at the water base of the hookah, for example by adhesion or a screw connection. The first closing element can thereby remain at the water base when opening the water base to empty it or fill it. Furthermore, a second closing element is provided, which comprises at least one connecting opening for at least one hookah hose and at least one continuous opening for a connection permeable to air between the water base and a hookah stem directly or indirectly arranged at the second closing element. In this context, "at least" means that several connecting openings for several hookah hoses can be provided, so that a hookah can be smoked by several, preferably up to four, users simultaneously.

The second closing element comprises an essentially cylindrical portion, by means of which it can be inserted into a recess in the first closing element, said recess being complementary to said cylindrical portion in shape and function. The cylindrical portion thereby comprises at least one indentation in the area of its outer wall, a locking element provided in the inner wall of the recess being detachably engageable in said indentation.

This means that in contrast to the closing systems described above, the detachable engagement no longer occurs between the water base and the closing system in their entirety, but rather between two carefully matched closing elements. Moreover, the connection no longer occurs as a friction-type or force-fitting connection, but as a form fit between the locking element and the indentation, whereby a mechanically highly stable connection between the closing system and the water base can be realized.

Although it is sufficient for the essence of the invention to provide one locking element and one indentation, it is nevertheless advantageous to provide a plurality of locking elements and corresponding indentations.

The design of the indentation or the plurality of indentations is generally of no importance as long as a secure lock is ensured between the locking element and the indentation. According to a preferred embodiment of the invention, the indentation is formed as a circular groove surrounding the cylindrical portion. On the one hand, the advantage of this is that the second closing element can be inserted into the first closing element in any preferred rotating position and, on the other hand, a rotatability of the two closing elements relative to each other can be realized, so that the hookah hose can be easily passed between several users without the hookah itself having to be moved. An especially easy rotatability is realized when the locking elements are formed as rolling elements, for example as locking balls, which can roll in the circular groove.

According to a particularly preferred embodiment of the invention, in order to release the connection between the two closing elements and to remove the second closing element from the water base, the first closing element comprises an actuating element, which is provided with at least one actuating surface interacting with the locking element, said actuating surface disengaging the locking element from the indentation when the actuating element is being actuated. This therefore results in a simple and easy operability.

The locking element can be formed on the second closing element in generally any manner, for example integrally. According to another preferred embodiment of the invention, however, the first closing element comprises a connecting piece having an essentially cylindrical portion for being attached on the water base, wherein the wall of the cylindrical portion comprises at least one continuous recess in which the locking element is arranged radially displaceable. In other words, a sort of cage is formed by the wall of the cylindrical portion having the recesses, said cage otherwise holding the locking element or the plurality of locking elements in their position while their radial displaceability is maintained.

According to a variation, the actuating element is formed as an actuating sleeve, which is arranged radially outward on the cylindrical portion so as to overlap the cylindrical portion in an axially displaceable manner. The actuating sleeve thereby comprises at least one axially inclined surface, by means of which the locking element can be brought from a first position, in which the locking element is disengaged, into a second position, in which the locking element engages in the indentation. In other words, in this embodiment the connection is released by axially displacing the actuating sleeve.

According to a variation alternative to the above, in another embodiment the actuating element is formed as an actuating sleeve, which is arranged radially outward on the cylindrical portion so as to overlap the cylindrical portion in a rotatable manner. The actuating sleeve thereby comprises at least one inclined surface extending in a circumferential direction and by means of which the locking element can be brought from a first position, in which the locking element is disengaged, into a second position, in which the locking element engages in the indentation. In contrast to the embodiment mentioned above, the connection is released by rotating the actuating sleeve on the first closing element.

According to another embodiment, the first closing element comprises a spring device, with which the actuating sleeve is forced into the second position. Thus, a reliable and secure self-acting lock is realized after inserting the second closing element.

In particular, in order to enable inserting the second closing element into the recess of the first closing element without having to simultaneously actuate the actuating sleeve, according to another embodiment of the invention the cylindrical portion of the second closing element comprises at lest one wedge-shaped or cone-shaped surface in such a manner that the locking element is pushed radially outward when inserting the second closing element into the first closing element. In other words, the two closing elements can simply be inserted into each other, wherein, in particular when using a spring device, as described above, a self-acting lock and overall a quick-action closing system, which can be easily produced and easily disengaged, is realized.

As commonly known, the hookah stem can be permanently arranged at the closing system or at the second closing element, respectively; the hookah stem can thereby be formed in one or several parts. According to another embodiment, however, the hookah stem in the second closing element is mounted rotatable thereto. In other words, when rotating the second closing element, for example when passing the hookah hose to other users within a group, the hookah stem is not displaced and can be held in place, for example. Thus, the safety against the coals unintentionally falling from the hookah plate arranged on the hookah stem is enhanced. A particular advantage is realized when the hookah stem is supported directly or indirectly at the water base via a torque arm in a torque-proof manner with respect to the water base. This makes holding the hookah stem in place superfluous.

As commonly known, the connecting opening for the hookah hose opens directly or indirectly into the water base via a recess. In particular in order to prevent undesired secondary air from being sucked through unused connecting openings, when several connecting openings for one hookah hose in each case are arranged, a corresponding valve arrangement, in the type of a check valve, can be provided in the recess or the recesses. Thereby, the valve arrangement can comprise a valve body being exposed to gravity and/or to a spring force, wherein said valve body can be brought into sealing contact at a valve seat being detachably attached in or at the recess at its frontal face. By disengaging the valve seat, the valve arrangement or at least the valve body, respectively, can be removed, inserted or exchanged as required.

In particular in order to blow fresh air into the air space of the water base while using the hookah, for example to reduce the smoke temperature, according to another embodiment, a valve unlocking device can be provided, by means of which the sealing contact of the valve body at the valve seat can be reversed.

The valve seat can be formed by a ring-like closing system or by a sleeve which can be screwed into the recess. The closing system or the sleeve can thereby be essentially flush with the underside of the first closing element. According to another embodiment, the sleeve can project over the plane formed by the underside of the closing element towards the water base, thus resulting in a better exchange of air in the water base.

In particular when air is blown into the air space of the water base by a valve opened by means of the unlocking device, the air can be directed outward by at least one further recess provided with a valve and the allocated connecting opening. An exhalation adapter can thereby be inserted into the opening, smoke rings in the type of a vortex being able to be produced by means of said exhalation adapter.

In the following, the invention is further explained by way of illustrations only showing exemplary embodiments.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
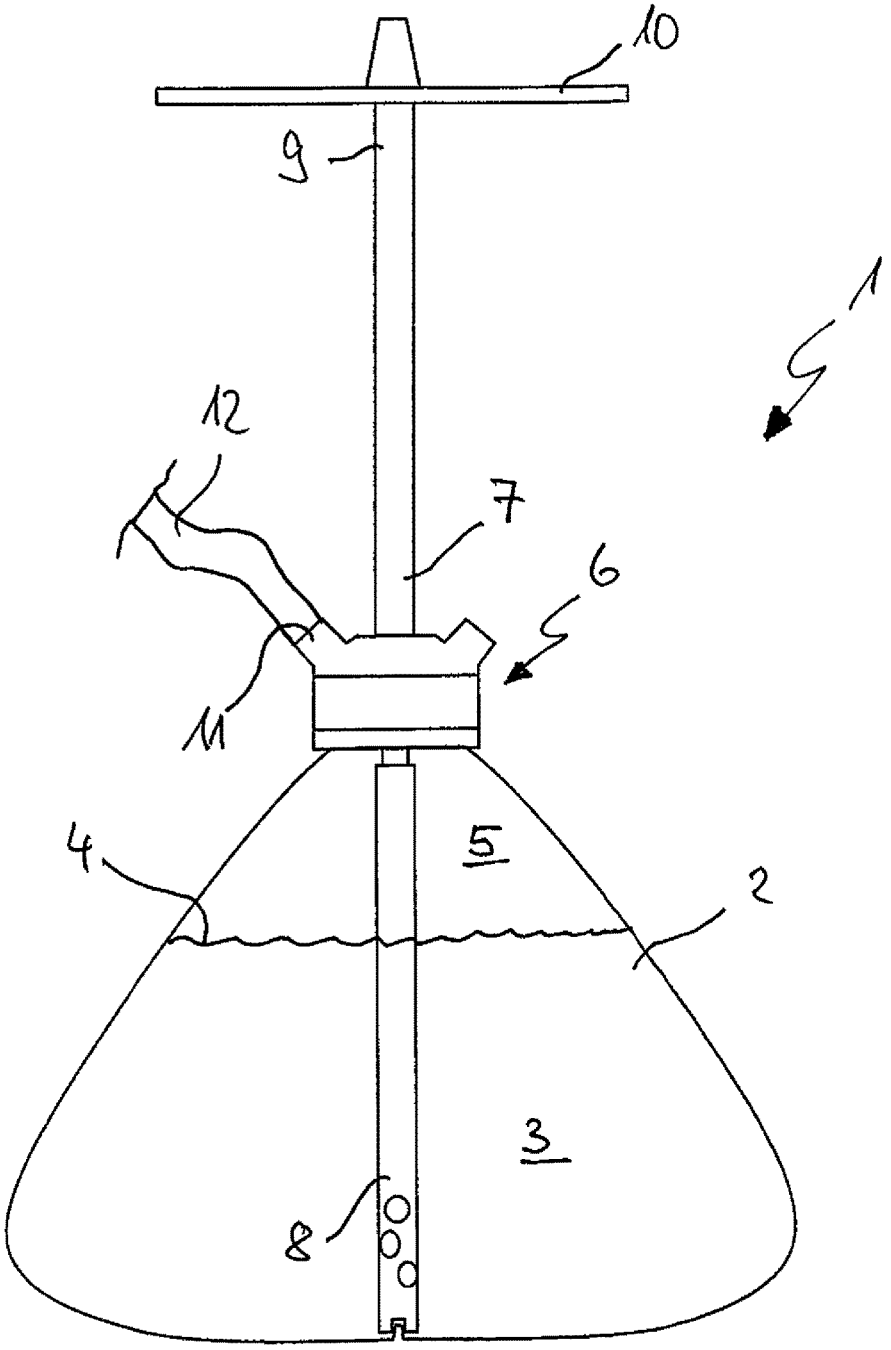
FIG. 1 is a schematic view, not true to scale, of the general design of a hookah.

To begin with, the hookah 01 shown in FIG. 1 comprises a water base 02 which is filled with water 03 in such a manner that an air space 05 remains above the liquid level 04. The water base 02 is closed with a closing system 06. A hookah stem 07 extends through the closing system, said hookah stem 07 opening below the liquid level 04 into the water 03 in the water base 02 with its lower end 08. In the area of its upper end 09, the hookah stem 07 is provided with a coal tray 10, on which hot coals and the tobacco to be vaporized are placed. A hookah hose 12 is arranged at the closing system 06 in a recess 11, which extends through the closing system 06 into the air space 05. If a user sucks on the hookah hose 12, he produces a negative pressure in the water base 02, more precisely in the air space 05, so that air enriched with the vaporized tobacco aromas is sucked through the hookah stem 07 and the water 03 is supplied to the user in a cooled, purified and humidified state as a result of said negative pressure.

Figure 2:
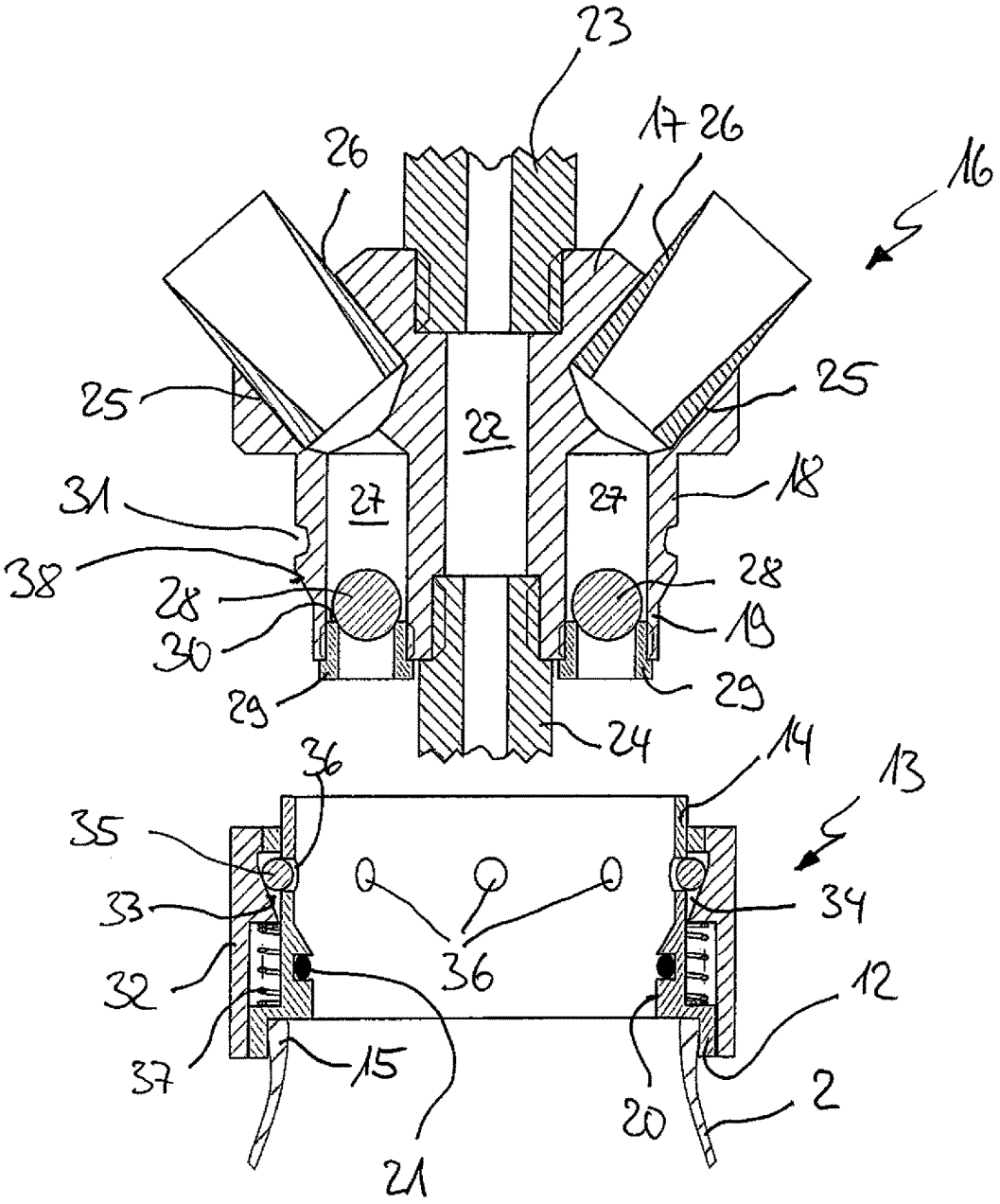
FIG. 2 is a longitudinal section of a first embodiment of a closing system according to the invention in a disengaged state.

The embodiment shown in FIG. 2 of a closing system according to the invention comprises a first closing element 13 which is attached to a water base 02. The closing element comprises an essentially cylindrical portion 14 which is provided with a flange-like section 15 at its lower end. The inner diameter of the flange-like section 15 is minimally larger than the outer diameter of the collar 15 of the water base 02, so that the closing element can be set on the collar of the water base and can be adhesively attached there, for example.

Furthermore, a second closing element 16 is provided, which comprises an upper area 17 and an also essentially cylindrical portion 18. The cylindrical portion 18 of the second closing element 16 is formed and dimensioned such that it can be inserted into and removed from the cylindrical portion 14 of the first closing element 13 with at least slight play. The lower end 19 of the cylindrical area 18 pointing towards the water base 02 has a smaller diameter than the remaining cylindrical portion, wherein the outer surface of the lower end 19 is formed as a sealing surface and interacts with a sealing element 21, an O-ring in this case, arranged in the inner wall of the complementary area 20 of the first closing element 13.

The second closing element 16 comprises a continuous opening 22. In this opening, a two-piece hookah stem 23 and 24 is attached, wherein the upper part 23 is screwed into the upper opening and the lower part 24 is screwed into the lower opening. The coal tray, not shown, is attached to the upper end, also not shown, of the upper part 23; the lower part 24 opens into the liquid present in the water base 02.

Two recesses 25 are arranged in the upper area 17 of the second closing element 16, each being arranged at an angle of approximately 45° to the hookah stem axis, a hose adapter 26 being inserted, for example screwed, into each of said recesses 25 for receiving a hookah hose, not shown. The recesses 25 for receiving the hose adapters 26 open into essentially cylindrical recesses 27 whose longitudinal axes are parallel to each other and to the longitudinal axis of the hookah stem 23, 24 and which are open towards the lower end of the second closing element 16.

Valve arrangements are provided in the recesses 27, said valve arrangements each comprising a valve body 28 formed as a valve ball and a valve seat 29. The valve seat is thereby formed sleeve-like and is screwed into the recess 27 from below, wherein the collar-side frontal surfaces of the sleeve serve as a valve seat.

The cylindrical portion 18 of the second closing element 16 is provided with an indentation 31 which is formed as a ring groove and surrounds the cylindrical portion 18 in a closed manner.

At the cylindrical portion 14 of the first closing element 13, an actuating element 32 formed as an actuating sleeve is provided, said actuating sleeve being arranged radially outward on the cylindrical portion 14 so as to overlap the cylindrical portion 14 in an axially displaceable manner. The actuating sleeve 32 comprises an axially inclined slope 33 which in this embodiment is formed as an essentially closed circumferential cone surface. An annular space 34 is thereby formed between the cone surface and the outer surface of the cylindrical portion 14, said annular space 34 expanding from the bottom, meaning from the water-base side, upward, meaning towards the second closing element. A plurality of locking elements 35 formed as locking balls are arranged in the annular space 34 in such a manner that they can project into the annular space 34 as well as into correspondingly allocated continuous recesses 36 in the cylindrical portion 14.

In the open position of the actuating sleeve 32 shown in FIG. 2 said actuating sleeve 32 is pushed downward against the force of a spring device 37, whereby the annular space 34 is expanded relative to the locking elements 35, so that the locking elements 35 can be inserted into the annular space at least far enough, so that the locking elements 35 no longer protrude into the inner space of the cylindrical portion 14 of the first closing element 13. If the actuating sleeve 32 is forced upward by the restoring force of the spring device 37, the locking elements 35 are pushed radially inward by the cone surface and protrude at least minimally into the inner space of the cylindrical portion 14. The recesses 36 are thereby formed in such a manner that the locking elements cannot entirely penetrate into the inner space but rather are held between the cylindrical portion 14 and the actuating sleeve 32 in the type of a cage.

Figure 3:
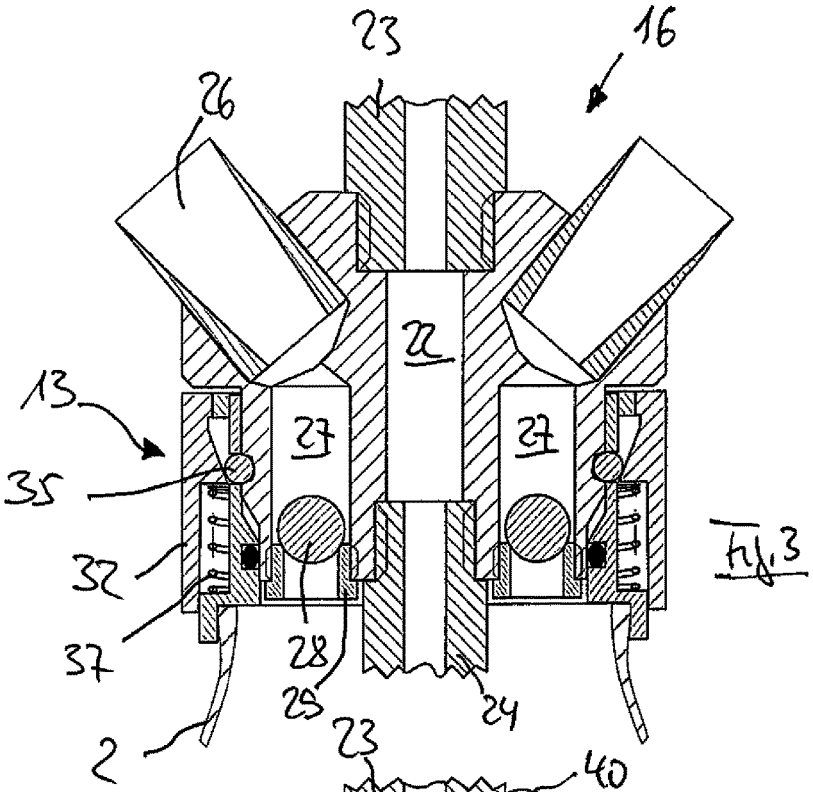
FIG. 3 is the embodiment according to FIG. 2 in an assembled state in a view according to FIG. 2.

As can be particularly seen in FIG. 3, in which the second closing element 16 is inserted into the first closing element 13, the locking elements 35 protrude into the ring groove-like indentation 31 and thereby produce an axially tight connection between the first and the second closing element. Due to the design of the indentation 31 as a ring groove, the two closing elements can be rotated freely with respect to one another.

The outer surface 38 of the second closing element 16 arranged beneath the indentation 31 is formed as a cone surface which expands in the shape of a cone from the bottom upward. This outer surface thereby leads to the locking elements being forced outward automatically when inserting the second closing element 16 into the first closing element 13, so that a deliberate actuation of the actuating sleeve 32 does not have to be effected when inserting the second closing element 16 into the first closing element 13.

In order to release the connection between the two closing elements 13 and 16, the actuating sleeve 32 is pushed downward out of the position shown in FIG. 3, whereby the annular space 34 behind the locking elements 35 is expanded. By lifting the second closing element 16, the locking elements 35 are pushed radially outward by the wall or the edge of the ring groove-like indentation 31, respectively, until the locking elements 35 are disengaged from the indentation 31.

By means of the valve arrangement 28, 29 described above, it is ensured that, independently of the amount of people simultaneously using the hookah, no undesired fresh air or secondary air can get into the air space of the water base, since the valves only open when a negative pressure is present or, in other words, when a user is sucking on the respective hookah hose. However, in order to intentionally blow fresh air into the air space, for example to reduce smoke temperature and/or water temperature, a valve unlocking device 39 can be provided in the area of a valve arrangement. In the embodiment shown in FIG. 4, which completely corresponds to the embodiment shown in FIGS. 2 and 3 except for the valve unlocking device, the valve device comprises an only schematically indicated rod 40 which engages through the first closing element 13 and can be actuated by an actuating handle 41 in the direction of the arrow F in such a manner that the valve body 28 is lifted from its allocated valve seat 29, whereby air can be blown in from the outside. In the embodiment according to FIG. 7, the valve body 28 is also lifted from its valve seat formed as a sleeve 42 by the illustrated valve unlocking device when pressing the actuating handle 41 via the rod 40 by pressing an unlocking body 43 or an end of the rod 40 between the valve seat 42 and the valve body 28.

Figure 4:
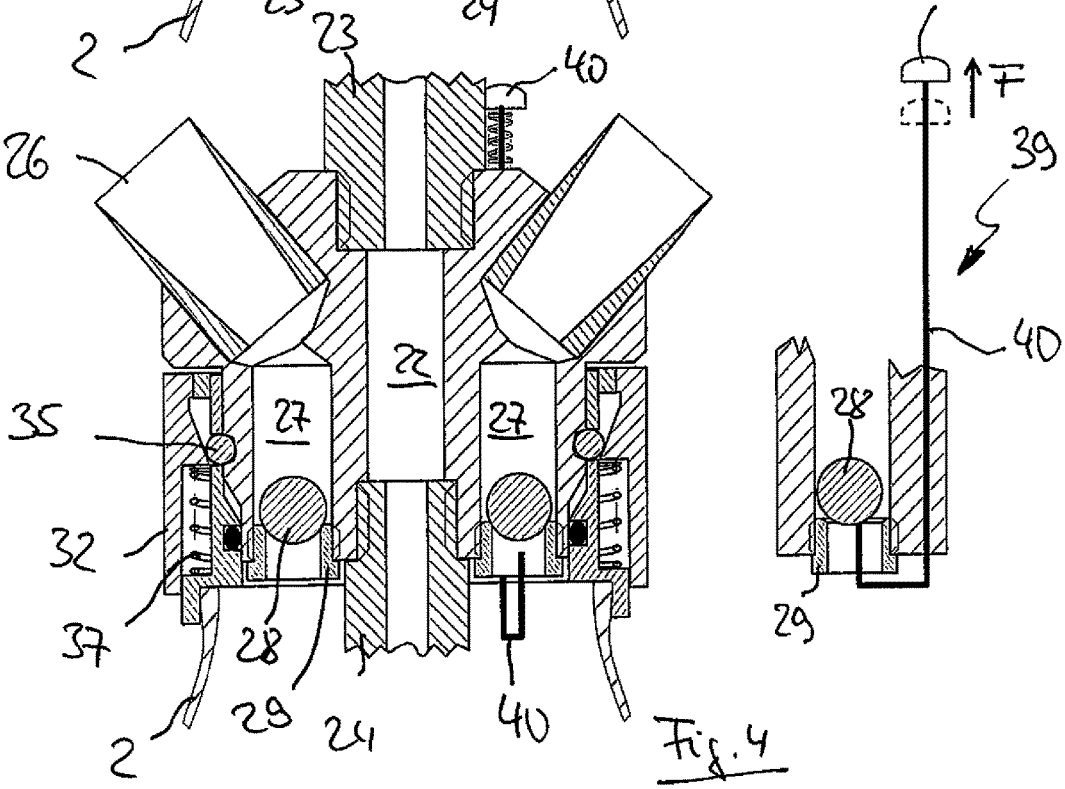
FIG. 4 is a second embodiment of a closing system according to the invention having a valve unlocking device in a view corresponding to FIG. 2.
Figure 7:
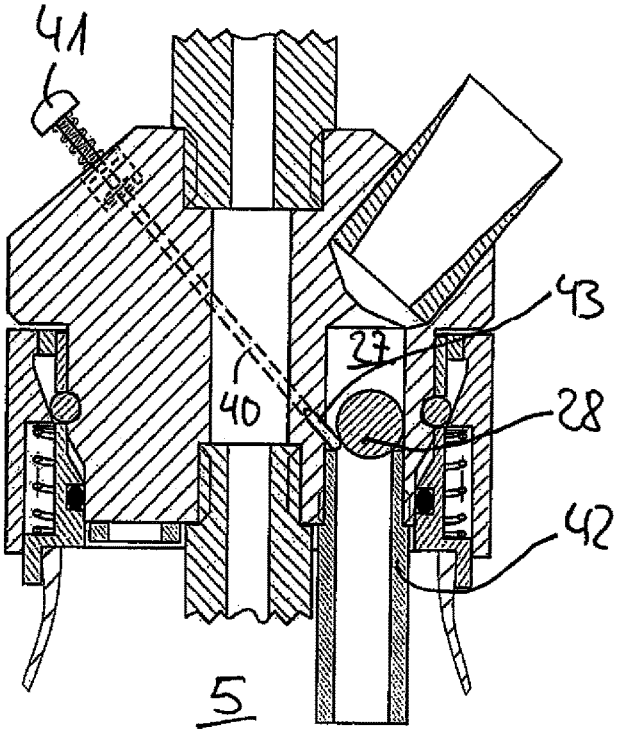
FIG. 7 is a fourth embodiment of a closing system according to the invention having a valve unlocking device.

Contrary to the embodiment according to FIG. 4, the valve seat in the valve system according to FIG. 7 is formed as a sleeve which protrudes over the plane formed by the underside of the first closing element downward into the air space 05 of the water base 02 after having been screwed into the recess 27.

Figure 8:
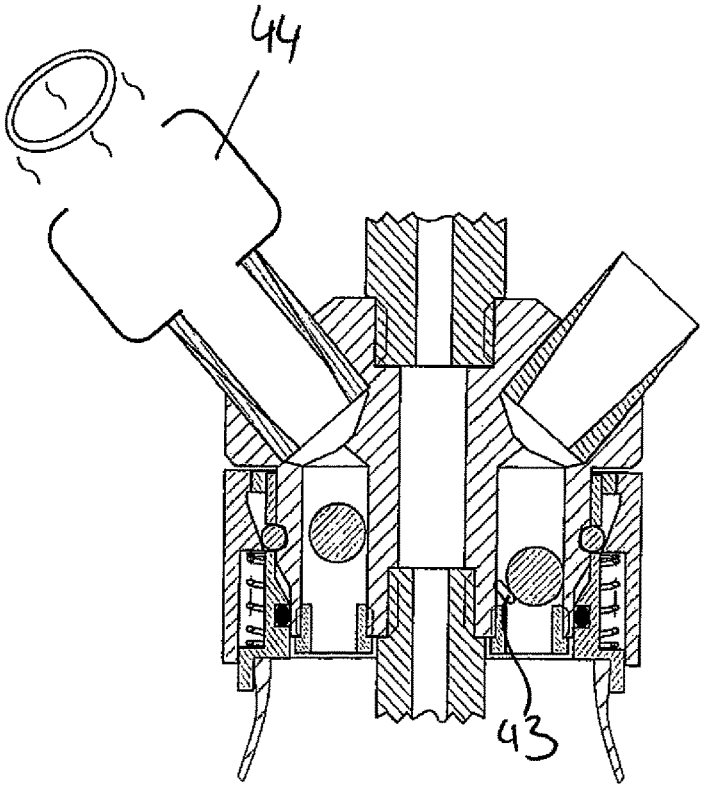
FIG. 8 is a fifth embodiment of a closing system according to the invention having an inserted exhalation adapter.

The embodiment shown in FIG. 8 essentially corresponds to the design of the embodiment according to FIG. 7, wherein only an exhalation adapter 44 is inserted into one of the recesses for receiving a hookah hose. Contrary to known exhalation adapters, which only comprise a valve device for preventing undesired secondary air from entering, the exhalation adapter 44 according to the invention at hand serves to produce smoke rings.

While the hookah stem 07 is permanently connected to the second closing element 16 and rotates with this element, if necessary, according to the embodiments described above, the embodiment according to FIGS. 5 and 6 comprises a hookah stem 47 which is rotatably mounted in the second closing element 16. The hookah stem comprises an upper hookah element 45, which is rotatably mounted in the second closing element via a roller bearing arrangement 48 and is sealed via a sealing arrangement 49 with respect to the second closing element. A lower hookah stem 46 is connected with, in particular screwed into, the upper hookah stem 45 at its downward-pointing end. The upper axial end of the lower hookah stem 46 comprises a hexagonal outer profile 51.

In order to prevent the hookah stem 47 from rotating along with the second closing element 16 when the latter is being rotated, the hookah stem abuts against the first closing element 13 via a torque arm 50 in the rotating direction and thereby indirectly abuts against the water base 02. In this embodiment, the torque arm 50 comprises two platelets which are attached to the first closing element 13 with their first end and protrude in the direction of the hexagonal outer profile 51 of the lower hookah stem 46 with their second end, opposing said hexagonal outer profile 51 with a minimal distance. If a rotating of the second closing element with respect to the first closing element is effected, the hexagonal outer profile 51 comes into contact at the torque arm 50, whereby rotating is reliably prevented.

Figure 5:
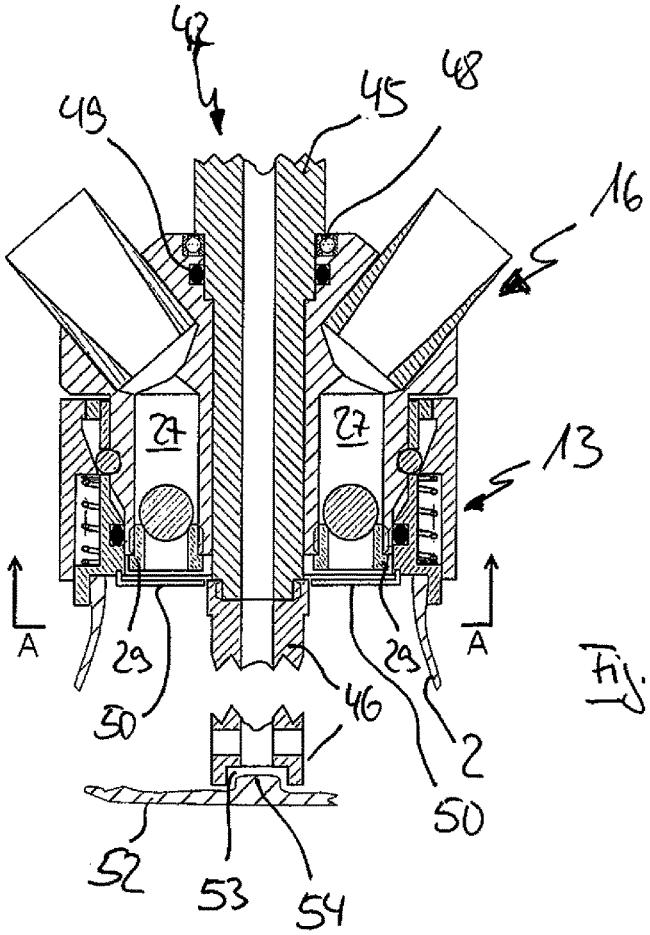
FIG. 5 is a third embodiment of a closing system according to the invention having a rotatable hookah stem.
Figure 6:
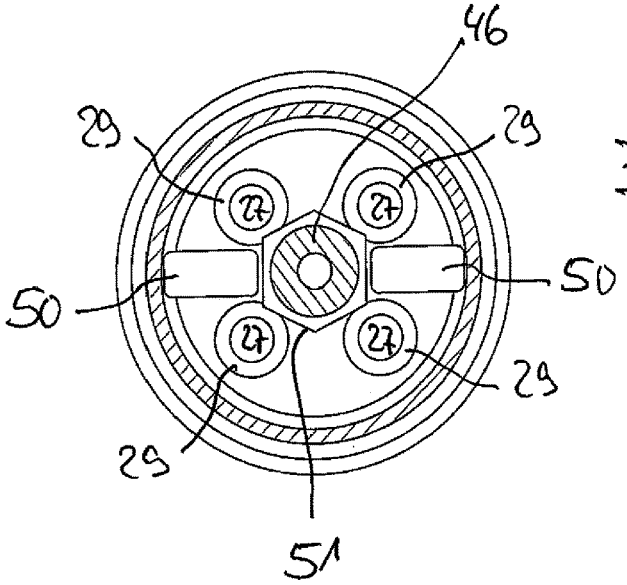
FIG. 6 is the embodiment according to FIG. 5 in a cross-sectional view A-A.

Another variation of a torque arm is shown in FIG. 5. The lower hookah stem 46 protrudes just over the bottom 52 of the water base 02 with its lower end. In the area of its lower end, the hookah stem 46 thereby comprises a groove-like indentation 53 in the type of a screw slot, with which it overlaps an elevation 54 at the bottom 52 being complementary thereto in shape and/or function essentially in a form-fitting manner. In this embodiment as well, the hookah stem 47 in total abuts against the water base 02 in the rotating direction, whereby a rotating of the hookah stem can be reliably prevented.

While specific embodiments of the invention have been shown and described in detail to illustrate the application of the principles of the invention, it will be understood that the invention may be embodied otherwise without departing from such principles.

The invention claimed is:

1. A closing system of a hookah, the closing system comprising:

a first closing element, which can be attached to a water base of the hookah;

a second closing element, which comprises at least one connecting opening for at least one hookah hose and at least one continuous opening for a connection permeable to air between the water base and a hookah stem arranged directly or indirectly at the second closing element, wherein the second closing element has an essentially cylindrical portion inserted into a recess in the first closing element, the recess being complementary in shape and function to said cylindrical portion, wherein the cylindrical portion comprises at least one indentation in the area of its outer wall; and at least one displaceable locking element provided in an inner wall of the recess and being detachably engageable in said indentation, the first closing element comprising a connecting piece for being attached on the water base, the connecting piece having an essentially cylindrical portion, wherein the wall of the cylindrical portion comprises at least one continuous recess in which the locking element is arranged radially displaceable, wherein an actuating element is formed as an actuating sleeve which is arranged radially outward on the cylindrical portion so as to overlap the cylindrical portion in an axially displaceable manner, wherein the actuating sleeve comprises at least one axially inclined surface, by means of which the locking element can be brought from a first position, in which the locking element is disengaged, into a second position, in which the locking element engages in the indentation.

2. The closing system according to claim 1, wherein the indentation is formed as a circular groove surrounding the cylindrical portion.

3. The closing system according to claim 1, wherein the first closing element comprises the actuating element, which is provided with at least one actuating surface interacting with the locking element, said actuating surface being able to disengage the locking element from the indentation when actuating the actuating element.

4. The closing system according to claim 1, wherein the first closing element comprises a spring device which forces the actuating sleeve into the second position.

5. The closing system according to claim 1, wherein the cylindrical portion of the second closing element comprises at least one wedge-shaped or cone-shaped surface configured such that the locking element is pushed radially outward when the second closing element is inserted into the first closing element.

6. The closing element according to claim 1, wherein a hookah stem is mounted in the second closing element so as to be rotatable with respect to the same.

7. The closing system according to claim 6, wherein the hookah stem is supported directly or indirectly at the water base via a torque arm in a torque-proof manner with respect to the water base.

8. The closing system according to claim 1, further comprising a valve arrangement, wherein a connecting opening for the hookah hose opens directly or indirectly into the water base via a recess, wherein the valve arrangement is provided in the recess.

9. The closing system according to claim 8, wherein the valve arrangement comprises a valve body being exposed to gravity and/or to a spring force, said valve body being able to be brought into a sealing contact at a valve seat which is detachably attached in or at the recess at it's a frontal face.

10. The closing system according to claim 9, further comprising a valve unlocking device, by means of which the sealing contact of the valve body at the valve seat can be reversed.

11. The closing system according to claim 9, wherein the valve seat is formed as a sleeve which can be screwed into the recess and protrudes over the plane formed by the underside of the first locking element towards the water base.

12. The closing system according to claim 1, further comprising an exhalation adapter which can be plugged in or on the connecting opening.

13. A closing system of a hookah, the closing system comprising:

a first closing element, which can be attached to a water base of the hookah;

a second closing element, which comprises at least one connecting opening for at least one hookah hose and at least one continuous opening for a connection permeable to air between the water base and a hookah stem arranged directly or indirectly at the second closing element, wherein the second closing element has an essentially cylindrical portion inserted into a recess in the first closing element, the recess being complementary in shape and function to the cylindrical portion, wherein the cylindrical portion comprises at least one indentation in the area of its outer wall; and at least one displaceable locking element provided in an inner wall of the recess and being detachably engageable in the indentation, the first closing element comprising a connecting piece for being attached on the water base, the connecting piece having an essentially cylindrical portion, wherein the wall of the cylindrical portion comprises at least one continuous recess in which the locking element is arranged radially displaceable, wherein an actuating element is formed as an actuating sleeve which is arranged radially outward on the cylindrical portion so as to overlap the cylindrical portion in a rotatable manner, wherein the actuating sleeve comprises at least one inclined surface extending in the circumferential direction, the locking element being able to be brought from a first position, in which the locking element is disengaged, into a second position, in which the locking element engages in the indentation, by means of the inclined surface.

14. A closing system of a hookah, the closing system comprising:

a first closing element, which can be attached to a water base of the hookah;

a second closing element, which comprises at least one connecting opening for at least one hookah hose and at least one continuous opening for a connection permeable to air between the water base and a hookah stem arranged directly or indirectly at the second closing element, wherein the second closing element has an essentially cylindrical portion inserted into a recess in the first closing element, the recess being complementary in shape and function to the cylindrical portion, wherein the cylindrical portion comprises at least one indentation in the area of its outer wall; and at least one displaceable locking element provided in an inner wall of the recess and being detachably engageable in the indentation, the cylindrical portion of the second closing element comprising at least one wedge-shaped or cone-shaped surface configured such that the locking element is pushed radially outward when the second closing element is inserted into the first closing element.

15. A closing system of a hookah, the closing system comprising:

a first closing element, which can be attached to a water base of the hookah;

a second closing element, which comprises at least one connecting opening for at least one hookah hose and at least one continuous opening for a connection permeable to air between the water base and a hookah stem arranged directly or indirectly at the second closing element, wherein the second closing element has an essentially cylindrical portion inserted into a recess in the first closing element, the recess being complementary in shape and function to the cylindrical portion, wherein the cylindrical portion comprises at least one indentation in the area of its outer wall; and at least one displaceable locking element provided in an inner wall of the recess and being detachably engageable in the indentation, wherein a hookah stem is mounted in the second closing element so as to be rotatable with respect to the same, the hookah stem being supported directly or indirectly at the water base via a torque arm in a torque-proof manner with respect to the water base.

16. A closing system of a hookah, the closing system comprising:

a first closing element, which can be attached to a water base of the hookah;

a second closing element, which comprises at least one connecting opening for at least one hookah hose and at least one continuous opening for a connection permeable to air between the water base and a hookah stem arranged directly or indirectly at the second closing element, wherein the second closing element has an essentially cylindrical portion inserted into a recess in the first closing element, the recess being complementary in shape and function to the cylindrical portion, wherein the cylindrical portion comprises at least one indentation in the area of its outer wall;

at least one displaceable locking element provided in an inner wall of the recess and being detachably engageable in the indentation;

a valve arrangement, wherein a connecting opening for the hookah hose opens directly or indirectly into the water base via a recess, wherein the valve arrangement is provided in the recess, the valve arrangement comprising a valve body being exposed to gravity and/or to a spring force, the valve body being able to be brought into a sealing contact at a valve seat which is detachably attached in or at the recess at a frontal face; and a valve unlocking device, by means of which the sealing contact of the valve body at the valve seat can be reversed.

17. A closing system of a hookah, the closing system comprising:

a first closing element, which can be attached to a water base of the hookah;

a second closing element, which comprises at least one connecting opening for at least one hookah hose and at least one continuous opening for a connection permeable to air between the water base and a hookah stem arranged directly or indirectly at the second closing element, wherein the second closing element has an essentially cylindrical portion inserted into a recess in the first closing element, the recess being complementary in shape and function to the cylindrical portion, wherein the cylindrical portion comprises at least one indentation in the area of its outer wall;

at least one displaceable locking element provided in an inner wall of the recess and being detachably engageable in the indentation;

a valve arrangement, wherein a connecting opening for the hookah hose opens directly or indirectly into the water base via a recess, the valve arrangement being provided in the recess, the valve arrangement comprising a valve body being exposed to gravity and/or to a spring force, the valve body being able to be brought into a sealing contact at a valve seat which is detachably attached in or at the recess at a frontal face, wherein the valve seat is formed as a sleeve which can be screwed into the recess and protrudes over the plane formed by the underside of the first locking element towards the water base.

* * * * *